United States Patent [19]

Gartner

[11] Patent Number: 4,523,716

[45] Date of Patent: Jun. 18, 1985

[54] COOLING AND HEATING AIR JET DEVICE IN BUILDING INTERIOR OR EXTERIOR STRUCTURE

[75] Inventor: Karl Gartner, Gundelfingen, Fed. Rep. of Germany

[73] Assignee: Yoshida Kogyo K.K., Tokyo, Japan

[21] Appl. No.: 519,372

[22] Filed: Aug. 1, 1983

[30] Foreign Application Priority Data

Aug. 2, 1982 [JP] Japan ..... 57-134895

[51] Int. Cl.[3] ..... F24F 3/00; F24D 5/10

[52] U.S. Cl. ..... 237/56; 98/31; 98/40.19; 98/41.3; 165/50; 237/46

[58] Field of Search ..... 98/31, 33 R, 40 R, 40 A, 98/40 C, 40 N, 41 SV; 237/46, 56; 165/50

[56] References Cited

U.S. PATENT DOCUMENTS

| | | | |
|---|---|---|---|
| 2,395,233 | 2/1946 | Richardson | 98/40 C |
| 3,202,078 | 8/1965 | Meek et al. | 98/31 X |
| 3,289,566 | 12/1966 | Todd | 98/31 X |
| 3,726,204 | 4/1973 | Lindeström | 98/40 N X |
| 4,060,914 | 12/1977 | Hoffman | 98/40 C X |
| 4,203,487 | 5/1980 | Gartner | 165/50 |
| 4,366,525 | 12/1982 | Baumgartner | 98/40 A X |

*Primary Examiner*—Harold Joyce

*Attorney, Agent, or Firm*—Hill, Van Santen, Steadman & Simpson

[57] ABSTRACT

A cooling and heating air jet device in a building interior or exterior structure including a framework of hollow vertical and horizontal wall support members is disclosed. The framework of hollow wall support members forms an air duct through which cooling or heating air is passed. A selected one of the wall support members is formed with a plurality of air jet openings spaced in the longitudinal direction of the same. The hollow interior of the selected one wall support member is divided into two adjacent and parallel chambers by a partition wall having a plurality of communication holes spaced in the longitudinal direction of the same. One of the chambers forms a part of the air duct and a first pressure equalizing chamber and the other one of the chambers forms a second pressure equalizing chamber. The plurality of air jet openings are formed in the side wall of the second pressure equalizing chamber.

6 Claims, 5 Drawing Figures

COOLING AND HEATING AIR JET DEVICE IN BUILDING INTERIOR OR EXTERIOR STRUCTURE

BACKGROUND OF THE INVENTION

This invention relates to a cooling and heating air jet device provided on a building interior or exterior structure such as a curtain wall, room partition or the like, for example, and more particularly, a cooling and heating air jet device provided on a framework including vertical and horizontal hollow shaped wall support members (the members will be simply referred to as "vertical member" and "horizontal member", respectively, hereinbelow) of the curtain wall, room partition or the like.

Heretofore, a cooling and heating air jet device provided on a framework including vertical and horizontal hollow shaped members of the curtain wall has been known, as shown, for example, in U.K. Pat. No. 2023277. The air jet device of this U.K. Patent includes the framework of hollow vertical and horizontal wall support members through which cooling or heating water is circulated. An air duct comprising a framework of hollow vertical and horizontal members is positioned parallel to, and in contact with, the framework of wall support members for heat exchanging with the same. A series of air jet openings is provided in the horizontal member for cooling or heating the interior of the building.

In this air jet device, however, as the same sized air jet openings are provided along the horizontal member of the air duct and the air jet is directly spouted from the air duct, the discharge of the air is not distributed uniformly in the longitudinal direction of the horizontal member. For example, if air is supplied through the horizontal member from one end thereof toward the other end of the same, the discharge of the air is maximum at one end, but it is minimum at the other end. If air is supplied through the horizontal member from both ends thereof as shown in FIG. 5, the discharge of air is maximum at both ends, but minimum in the central area as shown by line A in FIG. 5. Therefore, uniform cooling or heating of the room along the air duct cannot be effected in this known air jet device.

SUMMARY OF THE INVENTION

Therefore, one object of the present invention is to provide an air jet device which can exhibit uniform cooling or heating of the room along the length of the air duct.

Another object of the present invention is to provide an air jet device as aforementioned and such that the discharge of the air from the air duct can be controlled.

Another object of the present invention is to provide an air jet device as aforementioned and such that the spout out direction of the air jet from the duct can be controlled.

Another object of the present invention is to provide an air jet device as aforementioned and wherein the construction and operation is simple.

The present invention may be summarized as an air jet device in a building interior or exterior structure including a framework of hollow vertical and horizontal wall support members, the framework of wall support members forming an air duct through which cooling or heating air is passed, a selected one of the wall support members being formed with a plurality of air jet openings spaced in the longitudinal direction of the same, the hollow interior of the selected wall support member being divided into two adjacent and parallel chambers by a partition wall having a plurality of communication holes spaced in the longitudinal direction of the same, one of the chambers forming a part of the air duct and a first pressure equalizing chamber and the other of the chambers forming a second pressure equalizing chamber, and the plurality of air jet openings being formed in the side wall of the second pressure equalizing chamber.

With the above-mentioned construction and arrangement of the components, when an adjusted air is supplied through the selected one wall support member, the adjusted air is first supplied to the first pressure equalizing chamber where the pressure distribution of the air is slightly equalized, then the pressure-equalized air is passed through the communication holes in the partition wall into the second pressure equalizing chamber and then spouted through the air jet openings in the second pressure equalizing chamber whereby the pressure distribution in the air is further equalized to improve cooling or heating efficiency.

The above and other objects and attendant advantages of the present invention will be more readily apparent to those skilled in the art from a reading of the following detailed description in conjunction with the accompanying drawings which show one preferred embodiment of the invention for illustration purposes only, but not to limit the scope of same in any way.

DESCRIPTION OF THE PREFERRED EMBODIMENT

Figure 1:
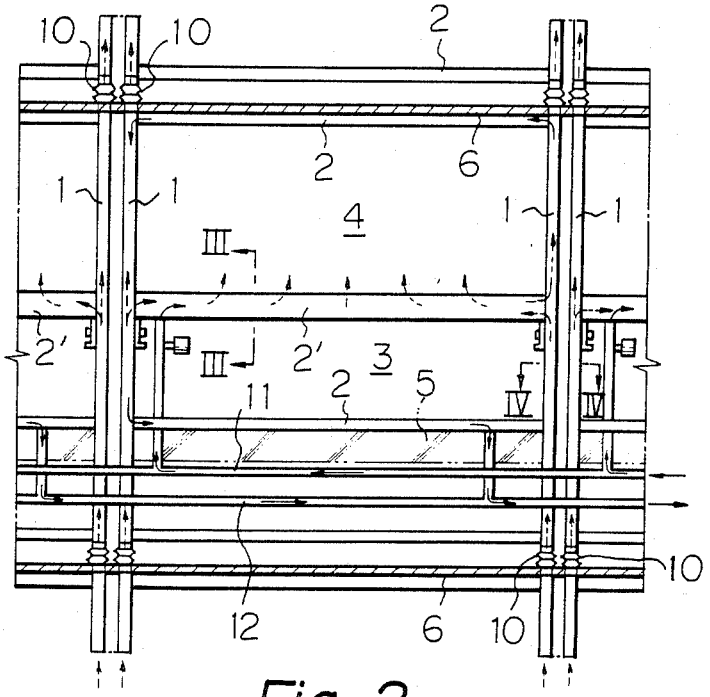
FIG. 1 is a schematic front elevational view of a curtain wall having the device of the invention incorporated therein as seen from the interior side thereof.

FIGS. 1 through 4 show the cooling and heating air jet device of the invention as being provided on a curtain wall which constitutes a building exterior wall. The curtain wall comprises a plurality of identical curtain wall units each including vertical and horizontal hollow wall support members 1 and 2,2', connected together to provide a framework for supporting members such as adiabatic panels 3 and pair glass sheets 4 on the outside of the framework. The curtain wall units are secured to the support portion of the building by means of fasteners or the like. In FIG. 1, reference numerals 5 and 6 denote the floor and ceiling boards of the building, respectively.

Each of the vertical and horizontal members 1 and 2, 2' is provided in the hollow interior thereof with an air flow passage 7 to provide an air duct and a heat medium flow passage 8 the latter of which is optional. These passages 7 and 8 may be formed integrally or separately.

As shown by the broken arrows in FIG. 1, clean air, the temperature and moisture of which has been adjusted, is introduced into the air flow passages 7 and a portion of the air is passed within the hollow intermediate horizontal member 2' provided in the intermediate position between the floor board 5 and the ceiling board 6 and is spouted through air jet openings 9 formed in the intermediate horizontal member into the interior of the room to thereby effect direct cooling and heating of the room. In FIG. 1, reference numeral 10 denotes a cylindrical expansible joint for communicating between the adjacent vertical members 1 in each curtain wall unit.

On the other hand, a heat medium such as cool water or warm water at a suitable temperature is supplied into the heat medium flow passages 8 to provide a cooling or heating effect to the air flow within passage 7 by the radiation heat of the medium. That is, the heat medium supplied from a supply conduit 11 is cycled through the passages 8 formed within the vertical and horizontal members 1, 2 and 2' as shown by the solid lines in FIG. 1 and returned to a return conduit 12.

Figure 3:
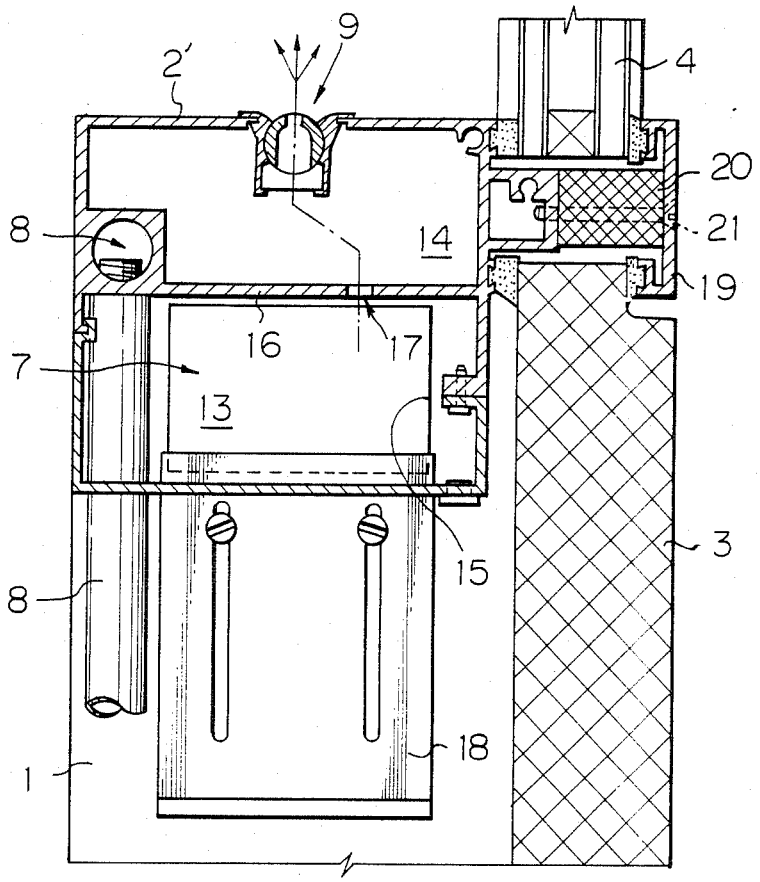
FIG. 3 is a cross-sectional view taken along the line III—III of FIG. 1.

FIG. 3 shows the details of the arrangement of FIG. 1 along the line III—III of FIG. 1 and it will be seen that a first chamber 13, as a portion of the air duct and a first pressure equalizing chamber, and a second chamber, as a second pressure equalizing chamber 14, are formed in adjacent and parallel relationship to each other by a partition wall 16 within the interior of the intermediate horizontal member 2' and in the illustrated embodiment, an additional heat medium flow passage 8 is provided at the room side in the first chamber. The first chamber 13 is in communication with an opening 15 in the side wall of the air flow passage 7 in the associated vertical member 1 and a portion of the adjusted air supplied to the vertical member 1 is passed through the opening 15 into the first chamber 13 in the horizontal member 2'.

Figure 5:
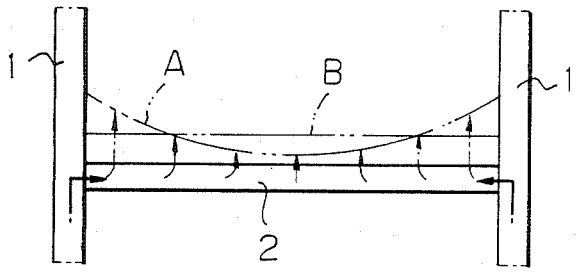
FIG. 5 is a graph showing the pressure distribution along the horizontal member in the device of the present invention together with that of the prior art for purposes of comparison.

The partition wall 16 which separates the first and second chambers 13, 14 from each other is provided with a plurality of communication holes 17 spaced in the longitudinal direction of the wall whereby the pressure distritution in the adjusted air is first slightly equalized in the first pressure equalizing chamber 13 due to the existence of pressure within the chamber 14 and the air is further passed through the communications holes 17 in the partition wall 16 into the second pressure equalizing chamber 14 from where the air is spouted in a substantially uniform pressure distribution through the air jet openings 9 in the side wall of the second pressure equalizing chamber 14 (the upper side wall as seen in FIG. 3). That is, if the first and second pressure equalizing chambers 13, 14 are not provided and air is instead directly spouted through openings 9 from the hollow interior of the intermediate horizontal member 2', the pressure of the air is not distributed uniformly in the longitudinal direction of the horizontal member 2' as shown by line A in FIG. 5 and thus, there is the problem that uniform cooling and heating along the horizontal member 2' cannot be effected. However, the device of the present invention solves the problem and the pressure of the spouted air is uniformly distributed as shown by line B in FIG. 5. The opening area of the communication holes 17 communicating between the first and second pressure equalizing chambers 13, 14 is determined by the amount of air required in the room and other factors.

Figure 2:
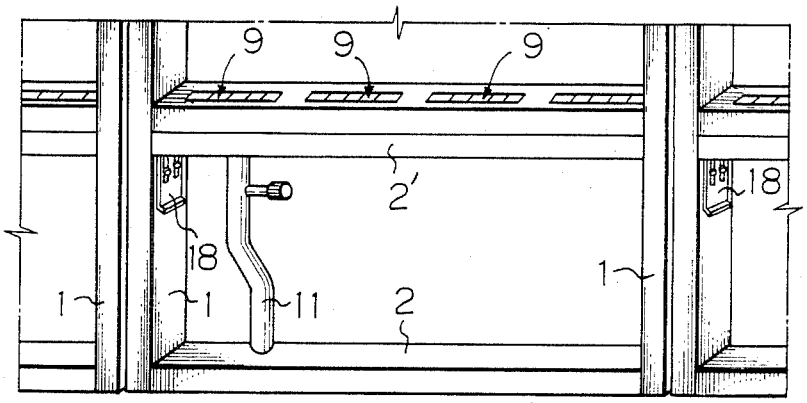
FIG. 2 is a fragmentary perspective view of the curtain wall as seen from the interior side thereof showing the air jet openings.

A cylindrical member having a plurality of openings spaced in the longitudinal direction thereof is rotatably provided in each of the associated air jet openings 9 and as the cylindrical member rotates, the orientation of the openings in the member is varied to thereby adjust the direction of the air jet spouted through the air jet openings 9. In FIGS. 2 and 3, reference numeral 18 denotes an air amount adjustment board movable upwardly and downwardly along the associated vertical member 1 and by manipulating the board 18, the opening area of the above-mentioned opening 15 in the vertical member 1 is adjusted to thereby adjust the amount of the adjusted air to be supplied to the first pressure equalizing chamber 1 in the intermediate horizontal member 2'.

In order not to damage the heat insulating system of the curtain wall, at the time of the attachment of the intermediate horizontal member 2', adiabatic panel 3 and pair glass sheet 4, the intermediate horizontal member 2' as an indoor member and a holding edge member 19 as an outdoor member are connected together by means of a screw 21 with an adiabatic block 20 interposed therebetween.

Figure 4:
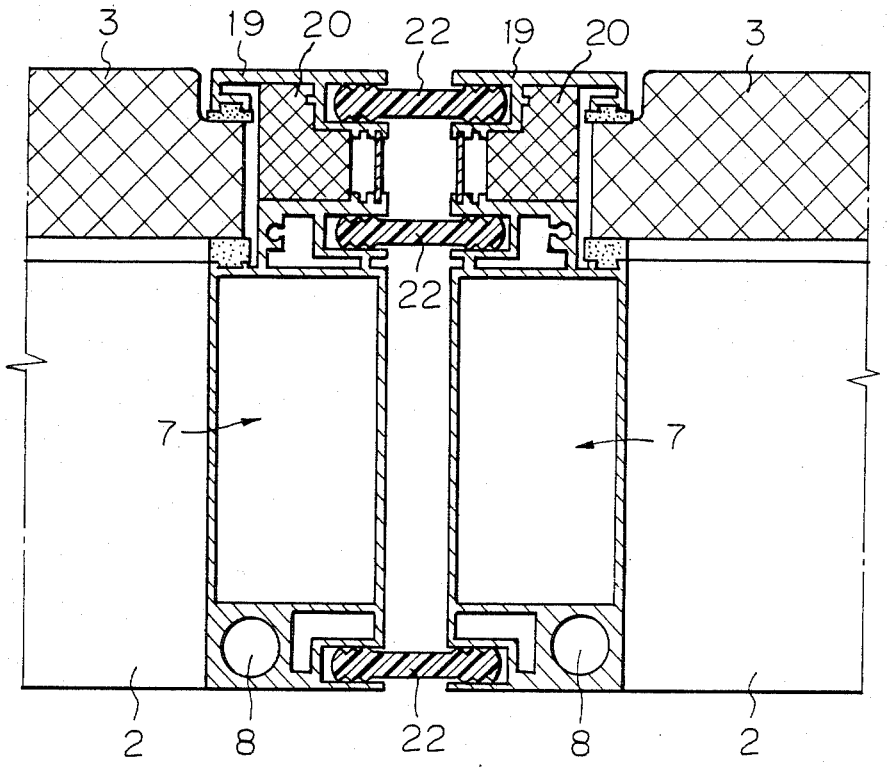
FIG. 4 is a cross-sectional view taken along the line IV—IV of FIG. 1.

FIG. 4 is a cross-sectional view taken along the line IV—IV of FIG. 1 and as shown in this Figure, a plurality of adiabatic packing bands 22 are interposed in the joint between the adjacent curtain wall units of the curtain wall on both the interior and exterior sides of the curtain wall unit in order to assure heat insulation between the interior and exterior sides of the curtain wall.

Although description has been made of the case in which the air jet device is provided on the intermediate horizontal member 2' of the framework of wall support members in the unit type curtain wall, the description is equally applicable to an indoor partition and the like. Although the air jet device is preferably provided in the intermediate position between the floor board and the ceiling board from the view point of the efficiency of cooling and heating, the device can be also provided on the vertical or horizontal member in any other position.

What is claimed is:

1. A cooling and heating air jet device in a building interior or exterior structure including a framework of hollow vertical and horizontal wall support members, said framework of hollow wall support members forming an air duct through which cooling or heating air is passed, a selected one of said wall support members being formed with a plurality of air jet openings spaced in the longitudinal direction of the same, the hollow interior of said selected wall support member is divided into two adjacent and parallel chambers by a partition wall having a plurality of communication holes spaced in the longitudinal direction of the same, one of said chambers forms a part of said air duct and a first pressure equalizing chamber and the other of said chambers forms a second pressure equalizing chamber, and said plurality of air jet openings are formed in the side wall of said second pressure equalizing chamber, each of said vertical and horizontal wall support members being provided in the hollow interior thereof with an air flow passage forming said air duct and a heat medium flow passage, said heat medium flow passage in said selected wall support member being integrally formed with said support member and provided in said second pressure equalizing chamber, said plurality of air jet openings positioned in the center portion of said side wall in the width direction thereof, said plurality of communication holes offset relative to said air jet openings on the exterior side of said partition wall, and said heat medium flow passage in said selected wall support member positioned near the interior side of said selected wall support member.

2. The cooling and heating air jet devices as set forth in claim 1, in which said selected one wall support member is any one of said vertical and horizontal wall support members.

3. The cooling and heating air jet device as set forth in claim 1, in which said framework includes a horizontal intermediate member positioned intermediate between a floor and a ceiling board, said selected wall support member being said horizontal intermediate member.

4. The cooling and heating air jet device as set forth in claim 3, in which said first chamber is in communication with an opening in the side wall of its associated vertical wall support member, and the opening area of said opening is adjustable by an air amount adjustment board movably provided along said associated vertical wall support member.

5. The cooling and heating air jet device as set forth in claim 4, in which a cylindrical member having a plurality of openings spaced in the longitudinal direction thereof is rotatably provided in each of said air jet openings.

6. The cooling and heating air jet device as set forth in claim 1, in which a cylindrical member having a plurality of openings spaced in the longitudinal direction thereof is rotatably provided in each of said air jet openings.

* * * * *